US006244765B1

(12) United States Patent
Harriman et al.

(10) Patent No.: US 6,244,765 B1
(45) Date of Patent: Jun. 12, 2001

(54) VIBRATION ISOLATING ATTACHMENT SYSTEM FOR INKJET CARRIAGES

(75) Inventors: Douglas L. Harriman, Portland, OR (US); Jason Quintana, Brush Prairie, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/345,701

(22) Filed: Jun. 30, 1999

(51) Int. Cl.[7] ..... B41J 19/06

(52) U.S. Cl. ..... 400/319; 400/320; 400/335; 400/336; 400/352; 400/336.1

(58) Field of Search ..... 400/335, 352, 400/320, 319, 336, 336.1, 337

(56) References Cited

U.S. PATENT DOCUMENTS 4,573,363 * 3/1986 Shin ..... 400/320 X
5,595,448 * 1/1997 Harada ..... 400/320
5,924,809 * 7/1999 Wotton et al. ..... 400/691
5,964,542 * 10/1999 Ruhe et al. ..... 400/352
6,004,050 * 12/1999 Rehman et al. ..... 400/319

FOREIGN PATENT DOCUMENTS 0962327 8/1999 (EP) .
59-111878 6/1984 (JP) .

* cited by examiner

*Primary Examiner*—John S. Hilten
*Assistant Examiner*—Mina H. Chau
(74) *Attorney, Agent, or Firm*—Flory L. Martin

(57) ABSTRACT

An inkjet printing mechanism includes a vibration isolating attachment system for securing a drive belt to an inkjet printhead carriage for increasing print quality by isolating the carriage from multi-directional vibrations generated by a carriage drive motor while propelling the carriage during printing. The vibration isolating member is of a resilient material having a first end coupled to a drive mechanism interface member which is joined to the belt, a second end coupled to a carriage interface member supported by the carriage, and a body section between the first end and the second end. Two or more vibration isolating members may be used, with a preferred shape being an I-shaped cross section. An inkjet printing mechanism having such a vibration isolating attachment system, and a method of method of isolating an inkjet printhead carriage from vibrations generated by a carriage drive motor, are also provided.

11 Claims, 3 Drawing Sheets

VIBRATION ISOLATING ATTACHMENT SYSTEM FOR INKJET CARRIAGES

FIELD OF THE INVENTION

The present invention relates generally to inkjet printing mechanisms, and more particularly to a vibration isolating attachment system for securing a drive belt to an inkjet printhead carriage for increasing print quality.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, each printhead is propelled back and forth across the page by a carriage assembly, with each printhead shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. To facilitate priming, some printers have priming caps that are connected to a pumping unit to draw a vacuum on the printhead. During operation, partial occlusions or clogs in the printhead are periodically cleared by firing a number of drops of ink through each of the nozzles in a clearing or purging process known as "spitting." The waste ink is collected at a spitting reservoir portion of the service station, known as a "spittoon." After spitting, uncapping, or occasionally during printing, most service stations have a flexible wiper that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solids content than the earlier dye-based inks, which results in a higher optical density for the new inks. Both types of ink dry quickly, which allows inkjet printing mechanisms to use plain paper.

Other research has focused on increasing printing resolutions, by decreasing the size of the ink droplet. Smaller ink droplets must be more accurately positioned on the print media to reproduce the desired image. Thus, ink drop placement requirements for high-quality images has become a very exacting art. Unfortunately, small, regularly repeated deviations from the expected drop placement can cause image striping that is unacceptable and degrades the print quality. These repeated droplet deviations may be caused by variations in the velocity of the printhead as it scans across the page, as well as from drop firing direction errors. The invention claimed below addresses the first of these problems, periodic variations in the velocity of the printhead. One common source of these periodic variations in the printhead velocity was found to be vibrations induced in the carriage by the energy efficient, economical electric motor used to drive the printhead carriage back and forth across the page.

One earlier solution to the problem of isolating the moving printhead from the vibrations induced by the carriage motor consisted of inserting a metal compression spring between the drive belt which couples the motor with the carriage. Unfortunately, use of this metal compression spring had several limitations. First, if relative motion between touching parts is required, such as between features used to retain the system to the carriage, any friction caused by the metal compression spring can keep these parts from freely moving, so no vibration isolation is achieved. This is often the case for the very small vibrations caused by the carriage drive motor. Second, space limitations within a compact printer may make it difficult to locate the metal springs into the available space. A third disadvantage of the compression spring solution is that adding any damping to the metal spring requires the addition of another part to the printer, increasing the part cost as follows assembly costs. Finally, if the printhead vibration is not in the direction of the compression spring, vibration isolation is never achieved.

Another solution for isolating these periodic vibrations caused by the carriage motor consisted of placing a damping material, such as a foam or rubber pad, between the motor and the motor mount on the chassis. While this solution isolated the vibrations transferred from electric motor to the printer chassis, it failed to directly isolate the carriage assembly from motor vibrations.

Thus, a need exists for isolating the printhead carriage from periodic vibrations induced by the carriage drive motor, to eliminate undesirable stripe marks for appearing on the printed image.

SUMMARY OF THE INVENTION

According to one aspect of the present invention, an attachment system is provided for coupling an inkjet printhead carriage to a drive motor which generates vibrations in an inkjet printing mechanism. The attachment system includes a drive mechanism coupled to the drive motor, and a vibration isolating member. The vibration isolating member links the drive mechanism to the inkjet printhead carriage to isolate the carriage from at least some of the vibrations generated by the drive motor.

According to another aspect of the present invention, a method of isolating an inkjet printhead carriage from vibrations generated by a carriage drive motor in an inkjet printing mechanism is provided. The method includes the steps of coupling a drive mechanism to the carriage drive motor, and linking the drive mechanism to the inkjet printhead carriage with a vibration isolating member. In an absorbing step, at least some of the vibrations generated by the drive motor are absorbed by the vibration isolating member to isolate the carriage from the drive motor vibrations.

According to a further aspect of the present invention, an inkjet printing mechanism is provided including a vibration isolating attachment system, which may be as described above, for securing a drive belt to an inkjet printhead carriage.

An overall goal of the present invention is to provide a vibration isolating belt attachment system for an inkjet printhead carriage that facilitates printing of sharp, vivid images.

Another goal of the present invention is to provide an inkjet printhead carriage for an inkjet printing mechanism that operates more quietly while still being an economical purchase for consumers.

DETAILED DESCRIPTION OF THE PREFERRED EMBODIMENTS

Figure 1:
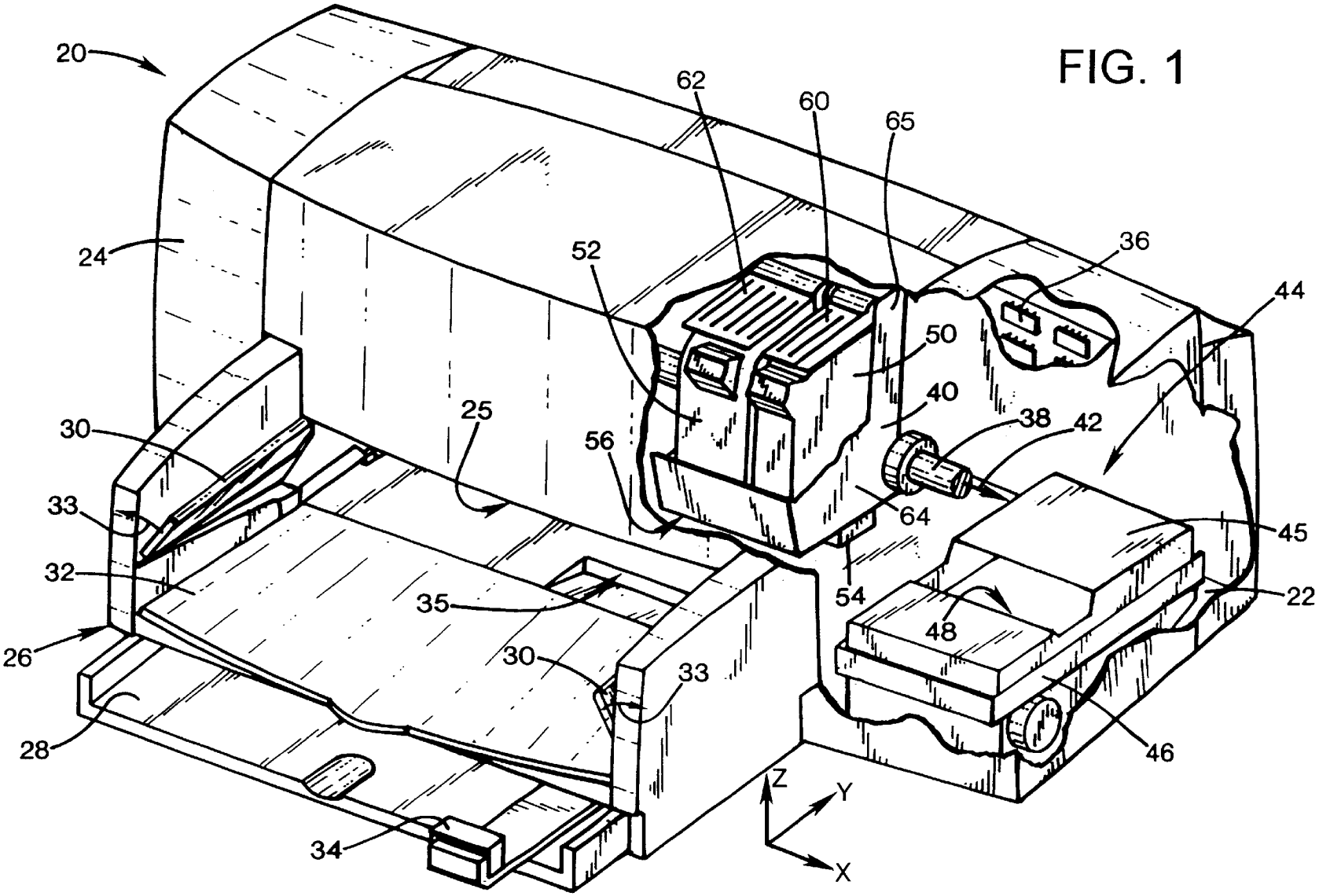
FIG. 1 is a fragmented, partially schematic, perspective view of one form of an inkjet printing mechanism including a vibration isolating attachment system of the present invention for securing a drive belt to an inkjet printhead carriage.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a printzone 25 by an adaptive print media handling system 26, constructed in accordance with the present invention. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional motor-driven paper drive rollers (not shown) may be used to move the print media from tray 28 into the printzone 25 for printing. After printing, the sheet then lands on a pair of retractable output drying wing members 30, shown extended to receive a printed sheet. The wings 30 momentarily hold the newly printed sheet above any previously printed sheets still drying in an output tray portion 32 before pivotally retracting to the sides, as shown by curved arrows 33, to drop the newly printed sheet into the output tray 32. The media handling system 26 may include a series of adjustment mechanisms for accommodating different sizes of print media, including letter, legal, A-4, envelopes, etc., such as a sliding length adjustment lever 34, and an envelope feed slot 35.

The printer 20 also has a printer controller, illustrated schematically as a microprocessor 36, that receives instructions from a host device, typically a computer, such as a personal computer (not shown). Indeed, many of the printer controller functions may be performed by the host computer, by the electronics on board the printer, or by interactions therebetween. As used herein, the term "printer controller 36" encompasses these functions, whether performed by the host computer, the printer, an intermediary device therebetween, or by a combined interaction of such elements. The printer controller 36 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 38 is supported by the chassis 22 to slideably support an inkjet carriage 40 for travel back and forth across the printzone 25 along a scanning axis 42 defined by the guide rod 38. One suitable type of carriage bearing support system is shown in U.S. Pat. No. 5,366,305, assigned to Hewlett-Packard Company, the assignee of the present invention. The carriage 40 is also propelled along guide rod 38 into a servicing region, as indicated generally by arrow 44, located within the interior of the casing 24. The servicing region 44 houses a service station 45, which may provide various conventional printhead servicing functions, such as wiping, spitting, capping and/or priming. In FIG. 1, a spittoon portion 48 of the service station is shown as being defined, at least in part, by the service station frame 46.

In the printzone 25, the media sheet receives ink from an inkjet cartridge, such as a black ink cartridge 50 and/or a color ink cartridge 52. The cartridges 50 and 52 are also often called "pens" by those in the art. The illustrated color pen 52 is a tri-color pen, although in some embodiments, a set of discrete monochrome pens may be used. While the color pen 52 may contain a pigment based ink, for the purposes of illustration, pen 52 is described as containing three dye based ink colors, such as cyan, yellow and magenta. The black ink pen 50 is illustrated herein as containing a pigment based ink. It is apparent that other types of inks may also be used in pens 50, 52, such as thermoplastic, wax or paraffin based inks, as well as hybrid or composite inks having both dye and pigment characteristics.

The illustrated pens 50, 52 each include reservoirs for storing a supply of ink. The pens 50, 52 have printheads 54, 56 respectively, each of which have an orifice plate with a plurality of nozzles formed therethrough in a manner well known to those skilled in the art. The illustrated printheads 54, 56 are thermal inkjet printheads, although other types of printheads may be used, such as piezoelectric printheads. The printheads 54, 56 typically include substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a conventional multi-conductor strip (not shown) from the controller 36 to the printhead carriage 40, and through conventional interconnects between the carriage and pens 50, 52 to the printheads 54, 56.

Preferably, the outer surface of the orifice plates of printheads 54, 56 lie in a common printhead plane. This printhead plane may be used as a reference plane for establishing a desired media-to-printhead spacing, which is one important component of print quality. Furthermore, this printhead plane may also serve as a servicing reference plane, to which the various appliances of the service station 45 may be adjusted for optimum pen servicing. Proper pen servicing not only enhances print quality, but also prolongs pen life by maintaining the health of the printheads 54 and 56.

Vibration Isolating Carriage

Belt Attachment System

Figure 2:
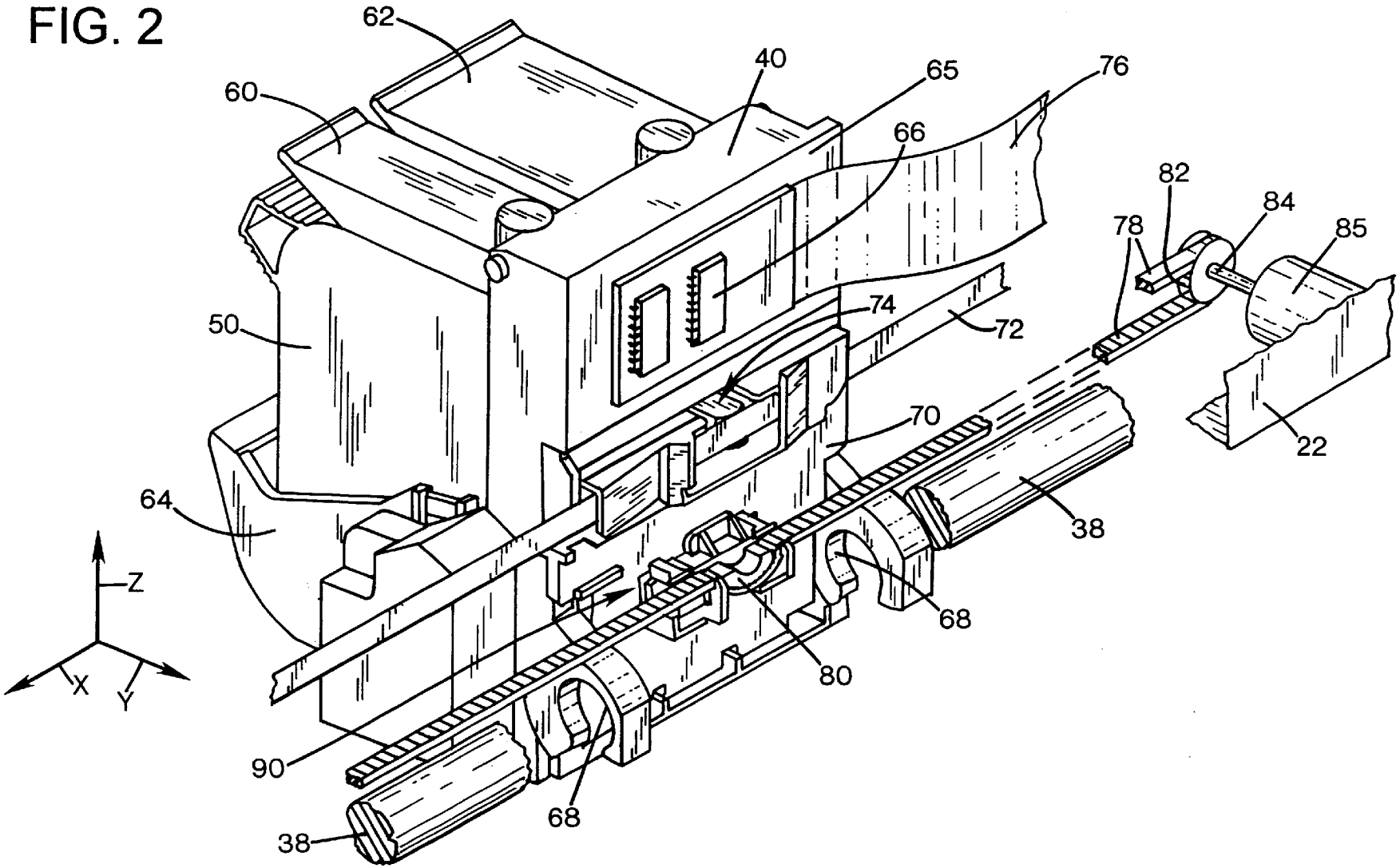
FIG. 2 is a rear perspective view of the vibration isolating attachment system of FIG. 1, shown securing a drive belt to an inkjet printhead carriage.

Referring to FIG. 2, the printhead carriage 40 has a pair of latches 60 and 62, which are used to secure the respective pens 50 and 52 within a body portion 64 of the carriage 40. The carriage also has an upright back wall portion 65, which has a rear surface upon which a carriage control circuit assembly 66 is mounted, with the circuit assembly 66 being illustrated schematically in FIG. 2. The carriage 40 also has a pair of guide rod bearings 68, which surround and slide upon the carriage guide rod 38, with the guide rod 38 shown partially broken away in FIG. 2.

Figure 3:
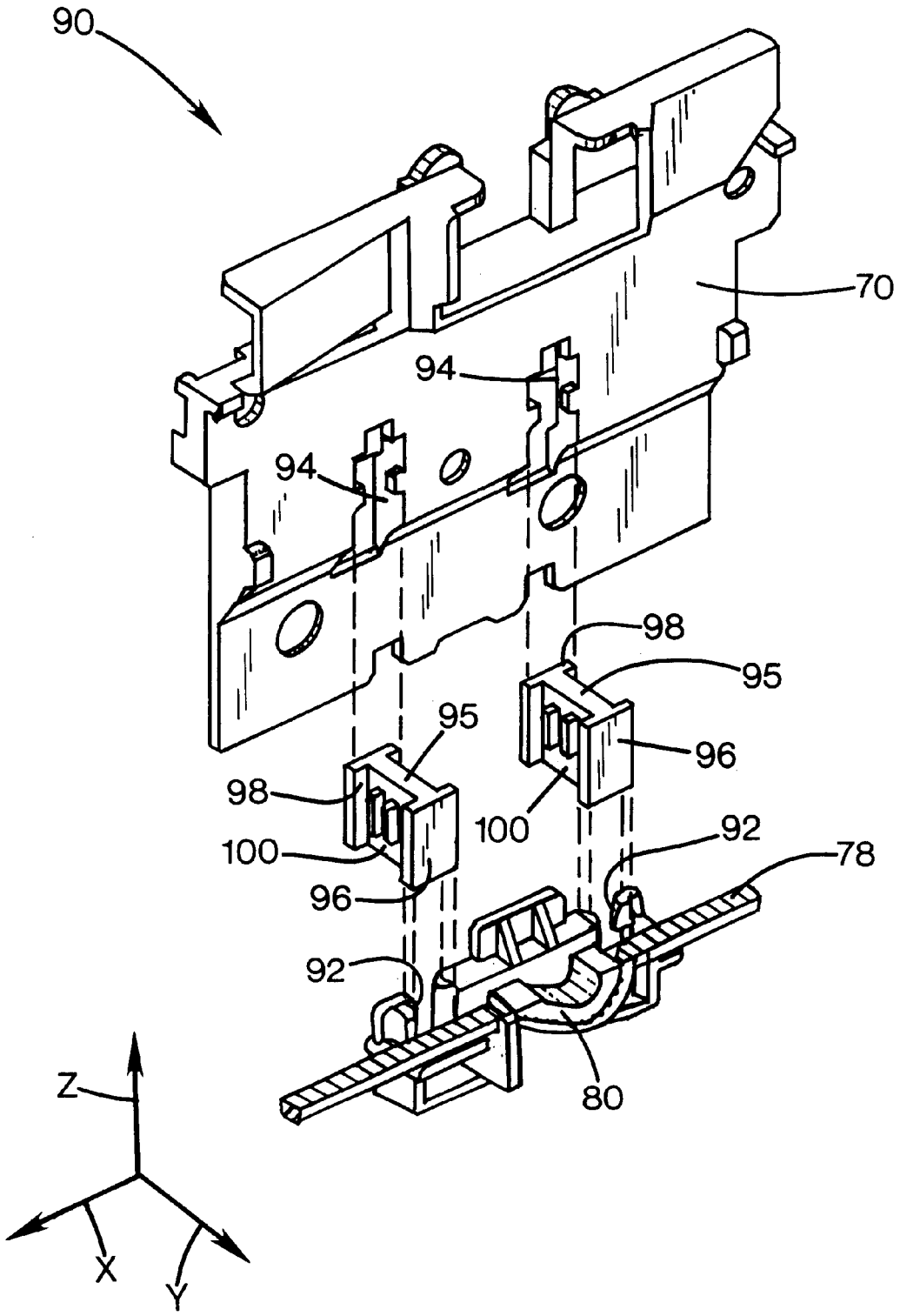
FIG. 3 is an exploded, rear perspective view of the vibration isolating attachment system of FIGS. 1 and 2.

Referring to FIGS. 2 and 3, a preferred embodiment of attachment system constructed in accordance with the present invention is illustrated for coupling the carriage 40 to a drive member which reciprocally propels the carriage 40 and printheads 54, 56 across the printzone 25 and over the service station 45. The illustrated attachment system has a drive mechanism including a carriage interface member 70 which is joined to the rear surface of the carriage wall 65. Preferably, an optical encoder strip 72 extends along the path of carriage travel from the printzone 25 to the service station 45. The carriage interface 70 slideably couples the optical encoder strip 72 to a location where a conventional optical encoder reader 74 may be used to relay positional information about the location of the carriage back to the controller 36. The positional information gathered by the encoder reader 74 may be first sent to the carriage circuitry 66, then to the controller 36 via a conventional flexible conduit or circuit member 76.

The illustrated drive mechanism also include an endless toothed drive belt 78 and a drive belt interface member 80 which securely grips the belt 78. As shown in FIG. 2, the drive belt 78 wraps around a drive spindle 82, which is coupled to an output shaft 84 of a carriage drive motor, such as a DC (direct current) motor 85. The motor 85 operates in response to control signals received from the printer controller 36. The carriage drive motor 85 is secured to the chassis 22 either in a conventional manner, or using a vibration isolator (not shown), such as a foam or rubber pad, as mentioned the Background section above. At the opposite end of the drive belt 78 opposite the drive motor 85, the printer chassis 22 may support a conventional idler pulley (not shown), which may include a conventional spring loaded tensioner to take up any undesirable slack in the drive belt 78.

FIG. 3 illustrates one preferred embodiment of a another portion of the illustrated attachment system, shown as a vibration isolating attachment system 90, constructed in accordance with the present invention, for coupling the carriage drive belt 78 to the carriage 40. Here, we see the drive belt interface member 80 defines a pair attachment fixtures, such as slots 92, while in the preferred embodiment, the carriage interface member 70 also defines a pair of attachment fixtures, such as slots 94. The attachment system 90 has a pair of vibration isolating attachment members, coupling members or links 95, which in the preferred embodiment each take the shape of an I-beam formed from an elastomeric material. Preferably, the attachment I-beams or links 95 are constructed of a resilient, non-abrasive, elastomeric material, such as nitrile rubber, an ethylene polypropylene diene monomer (EPDM) material, or more preferably, a hydrogenated acrylonitrile-butadiene (HNBR) material having a durometer on the Shore A scale selected between a range of 60 to 80, or more preferably between the range of 65–75, or even more preferably at a nominal durometer of 70+/−3, which is a typical manufacturing tolerance. Each I-beam link 95 has a head portion 96 and a foot portion 98 which are coupled together by a web member 100. The heads 96 of each link 95 are used to tightly secure the web 100 within slots 92 of the drive belt interface member 80. The feet 98 of each attachment member 95 are used to secure the web 100 within slots 94 of the carriage interface member 70.

The vibration isolating attachment members 95 link the drive mechanism to the inkjet printhead carriage 40 to isolate the carriage from at least some of the vibrations generated by the drive motor 85. By selecting the attachment links 95 to be of a resilient material, vibration transferred from operation of the motor 85 through belt 78 to the belt interface 80, is isolated and dampened by the links 95 from being transferred to be carriage 40. Indeed, use of the elastomeric attachment members 95 allows for dampening of vibrations in any of the X, Y, Z or composite directions, including twisting or torsional vibrations, transients and harmonics. By isolating the carriage 40 from vibrations of the belt drive motor 85, the printheads 54, 56 are also isolated from motor induced vibrations, promoting actor drop placement to print the desired image without striping print defects.

Conclusion

It is apparent that other configurations may be used as the attachment members, other than the illustrated I-beams configuration, such as cylindrical members, conical members, elongate members having other cross sectional shapes such as triangular or trapezoidal for instance, an elastomeric sheet having opposing side surfaces coupling the carriage to the belt, or a composite shape, such as an elastomeric sheet or block supported by the carriage with an arm(s) extending therefrom which are secured to the belt. Furthermore, other manners of joining the attachment links 95 to the drive belt 78 and to the carriage 40 may also be employed. For instance, the carriage interface member 70 may be eliminated in some printing mechanisms by directly joining the attachment numbers 95 to the carriage rear wall 65. Indeed, it may be possible to integrally mold or to bond the attachment numbers 95 directly to the drive belt 78 and eliminate the drive belt interface 80. Other such modifications may fall within the concepts described with respect to the illustrated preferred embodiment.

A variety of advantages are realized using the vibration isolating drive belt attachment system 90, including curing the problem of striping defects in the printed image induced by belt drive motor vibrations. Thus, higher quality printed images are obtained using vibration isolating belt attachment system 90. Moreover, use of the attachment system 90 avoids any sliding parts, so no extra friction forces are encountered as in the earlier vibration control schemes described in the Background section above. The desired spring characteristics of the attachment members 95 are produced in a compact space efficient manner, without increasing the overall size or desktop footprint of the printer 20. Moreover, the damping characteristics of the attachment members 95 may be easily modified for different styles and models of printers by making dimensional and material changes to the attachment members 95. Furthermore, since the elastomeric nature of the attachment links 95 allows stretching all directions, vibrations in any direction are dampened. By placing the isolation mechanism 90 between the printheads and the vibration source, here the belt drive motor 85, rather than by coupling at coupling the isolation mechanism to the chassis as in earlier systems, the desired vibrations are dampened independent of vibrations induced by other components within the printer, such as the vibrations induced by the media print advancing mechanism.

We claim:

1. An attachment system for coupling an inkjet printhead carriage to a drive motor which generates vibrations in an inkjet printing mechanism, comprising:

a drive belt driven by the drive motor;

an interface member which securely grips the belt; and a vibration isolating member which links the interface member to the inkjet printhead carriage to isolate the carriage from at least some of the vibrations generated by the drive motor, wherein the vibration isolating member has a first end coupled to the interface member, and a second end coupled to the inkjet printhead carriage and a body section between the first end and the second end.

2. An attachment system according to claim 1 wherein the drive belt comprises a toothed belt.

3. An attachment system according to claim 2 wherein the vibration isolating member is of an elastomeric material.

4. An attachment system according to claim 1 wherein the vibration isolating member has an I-shaped cross section, with the body section comprising the medial portion of the I-shape.

5. An attachment system according to claim 1 further including at least two vibration isolating members which both link the interface member to the inkjet printhead carriage.

6. An attachment system according to claim 1 further including a carriage mechanism interface member which couples the inkjet printhead carriage to the vibration isolating member.

7. An attachment system according to claim 1, further including a carriage interface member which couples the inkjet printhead carriage to the vibration isolating member, wherein the vibration isolating member is of an elastomeric material having a first end coupled to the interface member, a second end coupled to the inkjet printhead carriage, and a body section between the first end and the second end.

8. An inkjet printing mechanism, comprising:

a chassis;

an inkjet printhead;

supported by the chassis, a carriage that transports the printhead for motion along a scanning axis;

a carriage drive motor which generates vibrations while propelling the carriage along the scanning axis;

a drive belt driven by the drive motor;

an interface member which securely grips the belt; and a vibration isolating member which links the interface member to the inkjet printhead carriage to isolate the carriage from at least some of the vibrations generated by the drive motor, wherein the vibration isolating member has a first end coupled to the interface member, and a second end coupled to the inkjet printhead carriage and a body section between the first end and the second end.

9. An inkjet printing mechanism according to claim 8 wherein the vibration isolating member is of an elastomeric material.

10. An inkjet printing mechanism according to claim 8 wherein the vibration isolating member has an I-shaped cross section, with the body section comprising the medial portion of the I-shape.

11. An inkjet printing mechanism according to claim 8 wherein the vibration isolating member is of an elastomeric material having a first end coupled to the interface member, a second end coupled to the inkjet printhead carriage, and a body section between the first end and the second end.

* * * * *